US006261580B1

(12) United States Patent
Lehrter et al.

(10) Patent No.: US 6,261,580 B1
(45) **Date of Patent: *Jul. 17, 2001**

(54) TISSUE PAPER WITH ENHANCED LOTION TRANSFER

(75) Inventors: Mary Ruth Lehrter, Cincinnati; Paul Dennis Trokhan, Hamilton; Kenneth Douglas Vinson, Cincinnati, all of OH (US)

(73) Assignee: The Procter & Gamble Company, Cinncinnati, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/143,198

(22) Filed: Aug. 31, 1998

Related U.S. Application Data

(60) Provisional application No. 60/062,646, filed on Oct. 22, 1997.

(51) Int. Cl.[7] ..... A61K 9/00; A61K 6/00; A61K 25/34; B32B 3/10; D06N 7/04

(52) U.S. Cl. ..... 424/402; 424/400; 424/401; 428/153; 428/154

(58) Field of Search ..... 424/402, 400, 424/401; 428/153, 154

(56) References Cited

U.S. PATENT DOCUMENTS

| | | | | |
|---|---|---|---|---|
| 3,305,392 | | 2/1967 | Britt | 117/154 |
| 3,554,862 | | 1/1971 | Hervey et al. . | |
| 3,755,220 | | 8/1973 | Freimark et al. . | |
| 3,814,096 | | 6/1974 | Weiss et al. . | |
| 3,821,068 | | 6/1974 | Shaw . | |
| 3,896,807 | | 7/1975 | Buchalter . | |
| 4,112,167 | | 9/1978 | Dake et al. . | |
| 4,300,981 | | 11/1981 | Carstens . | |
| 4,513,051 | | 4/1985 | Lavash . | |
| 5,223,096 | * | 6/1993 | Phan et al. | 162/158 |
| 5,240,562 | | 8/1993 | Phan et al. | 162/158 |
| 5,264,082 | * | 11/1993 | Phan et al. | 162/158 |
| 5,525,345 | | 6/1996 | Warner et al. . | |
| 5,573,637 | * | 11/1996 | Ampulski et al. | 162/112 |
| 5,624,676 | * | 4/1997 | Mackey et al. | 424/414 |
| 5,650,218 | | 7/1997 | Krzysik . | |
| 5,698,076 | * | 12/1997 | Phan et al. | 162/111 |
| 5,716,692 | * | 2/1998 | Warner et al. | 428/153 |
| 5,871,763 | | 2/1999 | Luu et al. | 424/402 |

FOREIGN PATENT DOCUMENTS

| | | | |
|---|---|---|---|
| WO 97/30217 | 8/1997 | (WO) | D21H/17/07 |

* cited by examiner

*Primary Examiner*—Thurman K. Page
*Assistant Examiner*—S. Tran
(74) *Attorney, Agent, or Firm*—Edward Milbrada; Julia A. Glazer; Tara M. Rosnell

(57) ABSTRACT

Tissue paper webs useful in the manufacture of soft, tissue products such as wipes and facial tissues, and processes for making the webs are described. The tissue paper webs include papermaking fibers, an antimigration material and an emollient lotion. Preferred antimigration materials include quaternary ammonium compounds. Preferred emollient lotions include a hydrocarbon emollient. The preferred process for making the preferred invention includes providing the antimigration material to the papermaking furnish and depositing the emollient lotion onto at least one surface of the dried tissue web that includes an antimigration material.

21 Claims, 1 Drawing Sheet

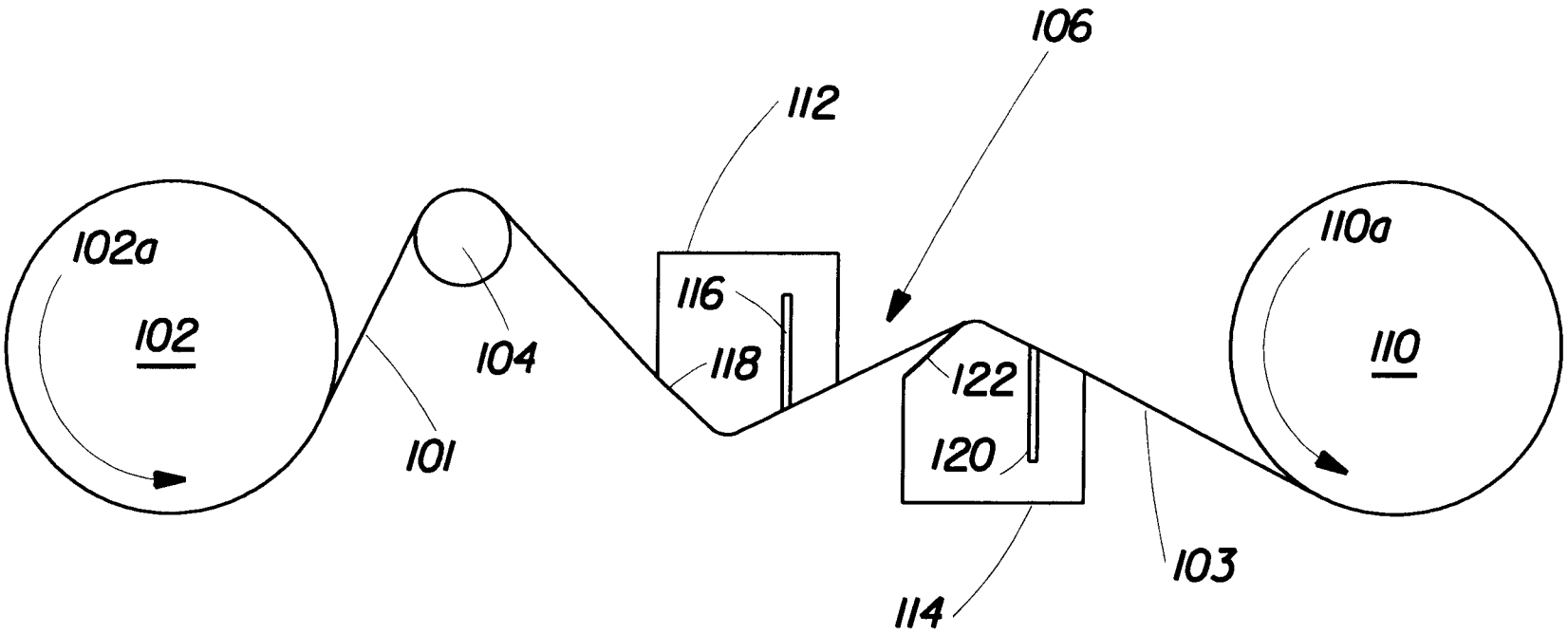
110a
110
103
106
122
120
114
112
116
118
104
101
102a
102

TISSUE PAPER WITH ENHANCED LOTION TRANSFER

CROSS REFERENCE TO RELATED APPLICATION

This application claims the benefit of U.S. Provisional Application No. 60/062,646 filed Oct. 22, 1997.

FIELD OF THE INVENTION

This invention relates to tissue paper webs. More particularly, it relates to soft tissue paper webs having a lotion disposed thereon which can be used for wipes, facial tissue, and similar products.

BACKGROUND OF THE INVENTION

The common cold and allergies with their associated weeping eyes and runny noses are a bane to mankind. In addition to the difficulties in breathing, seeing, talking, and disposing of nasal discharge, an individual afflicted with these disorders frequently must contend with a nose and areas surrounding it which are sore and irritated and which are, frequently, red and inflamed thereby calling the attention of others to his plight. The irritation and inflammation-the redness-can have several causes. A prime one is, of course, the sheer necessity of frequently blowing the nose into a tissue or cloth and wiping nasal discharge from the nose and the area surrounding it. The degree of irritation and inflammation caused by blowing and wiping is strongly related to the surface roughness of the implement used. The degree of irritation and inflammation is also strongly related strongly related to the number of times the nose and its surrounding areas must be contacted with an implement; the use of an implement which is relatively weak or relatively nonabsorbent will require a greater number of contacts with the face weak or relatively nonabsorbent will require a greater number of contacts with the face than will the use of a stronger or more absorbent implement which is able to contain a greater quantity of nasal discharge.

There have been numerous previous attempts to correct the problem of irritation and inflammation caused by blowing and wiping. One common approach has been to provide an implement which is smoother, softer, or both smoother and softer than previous implements. In modern industrialized societies, that implement is frequently a tissue paper product usually referred to as a facial tissue. Examples of such tissue paper products are shown in U.S. Pat. No. 4,300,981 which was issued to Carstens on Nov. 17, 1981 and in the various patents discussed in its specification.

The art has also attempted to address the problem of irritation and inflammation caused by blowing and wiping by softening tissue products used therefor with chemical additives. Freimark et al. in U.S. Pat. No. 3,755,220 issued Aug. 28, 1973 mention that certain chemical additives known as debonding agents interfere with the natural fiber-to-fiber bonding that occurs during sheet formation in papermaking processes. This reduction in bonding leads to a softer, or less harsh, sheet of paper. Freimark et al. go on to teach the use of wet strength resins to enhance the wet strength of the sheet in conjunction with the use of debonding agents to off-set undesirable effects of the wet strength resin. These debonding agents do reduce dry tensile strength, but there is also generally a reduction in wet tensile strength. Shaw, in U.S. Pat. No. 3,821,068, issued Jun. 28, 1974, also teaches that chemical debonders can be used to reduce the stiffness, and thus enhance the softness, of a tissue paper web. Chemical debonding agents have been disclosed in various references such as U.S. Pat. No. 3,554,862, issued to Hervey et al. on Jan. 12, 1971. U S. Pat. No. 5,264,082, issued to Phan and Trokhan on Nov. 23, 1993 describes compositions that have found broad use in the industry especially when it is desired to reduce the strength which would otherwise be present in the paper and when the papermaking process. Exemplary chemical debonding agents include quaternary ammonium salts such as trimethylcocoammonium chloride, trimethyloleylammonium chloride, dimethyldi(hydrogenated-tallow)ammonium methyl sulfate and trimethylstearylammonium chloride. Mono or diester variations of the before mentioned quaternary ammonium salts are also disclosed.

Armak Company, of Chicago, Ill., in their bulletin 76-17 (1977) disclose that the use of dimethyldi(hydrogenated-tallow)ammonium chloride in combination with fatty acid esters of polyoxyethylene glycols may impart both softness and absorbency to tissue paper webs.

Other workers have applied emollients, salves, cleansing agents, and the like to substrates such as tissue paper in an attempt not only to enhance the cleaning of the skin but also to reduce irritation and inflammation either through the lubricity of the substance applied to the implement or through the therapeutic action of the substance. This approach has been applied by, for example, Dake, et al in U.S. Pat. No. 4,112,167 issued Sep. 5, 1978 particularly in regard to toilet tissues. It has also been followed by Buchalter in U.S. Pat. No. 3,896,807 issued Jul. 29, 1975 and by Weiss et al in U.S. Pat. No. 3,814,096 issued Jun. 4, 1974. Lavash, in U.S. Pat. No. 4,513,051, issued Apr. 23, 1985 describes a tissue substrate carrying an emollient which has enjoyed particular commercial success when used in the context of a facial tissue. U.S. Pat. No. 5,525,345, issued to Warner, et al. on Jun. 11, 1996 describes additional lotion compositions and means of applying such lotions. Other lotion compositions are described in U.S. Pat. No. 5,650,218, issued to Krzysik, et al. on Jul. 22, 1997.

Despite the efforts of numerous researchers, the problem of the red, sore nose of the cold or allergy sufferer has not yet been completely resolved so improvements to such tissue products continue to be desired. Accordingly, it is an object of the present invention to provide a tissue paper product which causes less irritation and inflammation to a user's skin. It is a further object of this invention to provide a tissue paper product which will serve as a source of emollient, salve, or the like for application to the skin. It is yet a further object of the present invention to provide lotion-treated tissue paper products that are particularly efficient in transferring the lotion to a user's skin.

These and other objects are obtained using the present invention, as will become readily apparent from a reading of the following disclosure.

SUMMARY OF THE INVENTION

The present invention provides soft tissue paper webs having a soothing lotion disposed on the surface of the web and a process for making the webs. Briefly, the lotion treated tissue paper webs comprise:

(a) papermaking fibers formed into a tissue web, the web having opposed surfaces;

(b) an effective amount of an antimigration material; and (c) an emollient lotion disposed on at least one of the surfaces of the web To be suitable for the present invention the antimigration material must have a wettability tension less than or equal to the surface tension of the emollient lotion so as to minimize spreading of the emollient lotion on those surfaces wherein it is deposited.

Suitable antimigration materials include materials, such as fluorocarbons, silicones, and substituted long chain alkanes and alkenes, all of which can provide surfaces having a low wettability tension. Preferred antimigration materials are quaternary ammonium compounds. Examples of quaternary ammonium compounds suitable for use in the present invention include the well-known dialkyldimethylammonium salts such as ditallowdimethylammonium chloride, ditallowdimethylammonium methylsulfate, and di(hydrogenated tallow)dimethylammonium chloride, with di(hydrogenated)tallowdimethyl ammonium methyl sulfate being particularly preferred. Alternatively preferred variants of these compounds are what are considered to be mono or diester variations of the before mentioned dialkyldimethylammonium salts. These include so-called diester ditallow dimethyl ammonium chloride, diester distearyl dimethyl ammonium chloride, monoester ditallow dimethyl ammonium chloride, diester di(hydrogenated)tallow dimethyl ammonium methyl sulfate, diester di(hydrogenated)tallow dimethyl ammonium chloride, monoester di(hydrogenated) tallow dimethyl ammonium chloride, and mixtures thereof. Preferably, the antimigration material is provided in a papermaking furnish so as to enable association with the papermaking fibers.

The papermaking furnish may also include a plasticizer to aid in dispersion of the antimigration material and enhance the flexibility of the papermaking fibers. Examples of polyhydroxy plasticizers useful in the present invention include glycerol and polyethylene glycols having a molecular weight of from about 200 to about 2000, with polyethylene glycols having a molecular weight of from about 200 to about 600 being preferred.

Wet strength resins are also preferably included in the furnish to insure the treated tissue webs of the present invention are sufficiently strong during use. Wet strength resins useful in the present invention include all those commonly used in papermaking. Examples of preferred permanent wet strength resins include polyamide epichlorohydrin resins, polyacrylamide resins, and styrene-butadiene latexes.

A particularly preferred embodiment of the tissue web of the present invention comprises from about 0.03% to about 1.0% by weight of a quaternary ammonium compound, from about 0.03% to about 1.0% by weight of a polyhydroxy plasticizer, and from about 0.3% to about 1.5% by weight of a water-soluble permanent wet strength resin, all quantities of these additives being on a dry fiber weight basis of the tissue paper.

Disposed thereon is an emollient lotion. The emollient lotion softens, soothes, supples, coats, lubricates, moisturizes, or cleanses the skin. A particularly preferred emollient comprises a hydrocarbon emollient. Suitable hydrocarbon emollient materials include, for exemplary purposes only, hydrocarbon waxes such as paraffin, oils such as mineral oil, and silicone oil as well as petrolatum and more complex lubricants and emollients. A particularly preferred emollient lotion comprises a blend of mineral oil and paraffin.

Briefly, the process for making the tissue webs of the present invention comprises the steps of forming a papermaking furnish from the aforementioned components, deposition of the papermaking furnish onto a foraminous surface such as a Fourdrinier wire, and removal of the water from the deposited furnish to form a tissue web. The tissue web is then treated with the emollient lotion to form the lotion treated tissue. A preferred treatment method is slot extrusion of the melted emollient onto the tissue web.

All percentages, ratios and proportions herein are by weight unless otherwise specified.

BRIEF DESCRIPTION OF THE DRAWING

It is believed that the present invention will be better understood from the following description in conjunction with the accompanying drawing, in which reference numerals identify like elements and wherein:

FIG. 1 is a schematic representation illustrating a preferred process for applying the emollient lotion of the present invention to tissue paper webs.

The present invention is described in more detail below.

DETAILED DESCRIPTION OF THE INVENTION

While this specification concludes with claims particularly pointing out and distinctly claiming the subject matter regarded as the invention, it is believed that the invention can be better understood from a reading of the following detailed description and of the appended example.

As used herein, the terms tissue paper web, paper web, web, and paper sheet all refer to sheets of paper made by a process comprising the steps of forming an aqueous papermaking furnish, depositing this furnish on a foraminous surface, such as a Fourdrinier wire, and removing the water from the furnish as by gravity or vacuum-assisted drainage, with or without pressing, and by evaporation.

As used herein, an aqueous papermaking furnish is an aqueous slurry of papermaking fibers and the chemicals described hereinafter.

Tissue Web

Papermaking Furnish Components

Wood Pulp

The first step in a particularly preferred process for making the treated tissue paper of this invention is the forming of an aqueous papermaking furnish. The furnish comprises papermaking fibers (hereinafter sometimes referred to as wood pulp) and an antimigration material. A key element of any process for making the treated tissue paper of the present invention is to provide the antimigration material prior to providing the emollient lotion. The furnish also preferably further comprises at least one wet strength resin, and at least one polyhydroxy plasticizer. Each of these components will be hereinafter described.

It is anticipated that wood pulp in all its varieties will normally comprise the papermaking fibers used in this invention. However, other cellulosic fibrous pulps, such as cotton linters, bagasse, rayon, etc., can be used and none are disclaimed. Wood pulps useful herein include chemical pulps such as Kraft and sulfite pulps as well as mechanical pulps including for example, ground wood, thermomechanical pulps and chemically modified thermomechanical pulp (CTMP). Pulps derived from both deciduous and coniferous trees can be used. Also applicable to the present invention are fibers derived from recycled paper, which may contain any or all of the above categories as well as other non-fibrous materials such as fillers and adhesives used to facilitate the original papermaking. Preferably, the papermaking fibers used in this invention comprise Kraft pulp derived from northern softwoods, Kraft pulps derived from eucalyptus, and mixtures thereof.

Wet Strength Resins

The present invention also preferably comprises from about 0.01% to about 3.0%, more preferably from about 0.1% to about 2.0% by weight, on a dry fiber weight basis, of a water-soluble permanent wet strength resin. Most preferably, from about 0.3% to about 1.5% by weight, on a dry fiber weight basis, of a water-soluble permanent wet strength resin.

Permanent wet strength resins useful herein can be of several types. Generally, those resins which have previously found and which will hereafter find utility in the papermaking art are useful herein. Numerous examples are shown in the aforementioned paper by Westfelt, incorporated herein by reference.

In the usual case, the wet strength resins are water-soluble, cationic materials. That is to say, the resins are water-soluble at the time they are added to the papermaking furnish. It is quite possible, and even to be expected, that subsequent events such as cross-linking will render the resins insoluble in water. Further, some resins are soluble only under specific conditions, such as over a limited pH range.

Wet strength resins are generally believed to undergo a cross-linking or other curing reactions after they have been deposited on, within, or among the papermaking fibers. Cross-linking or curing does not normally occur so long as substantial amounts of water are present.

Of particular utility are the various polyamide-epichlorohydrin resins. These materials are low molecular weight polymers provided with reactive functional groups such as amino, epoxy, and azetidinium groups. The patent literature is replete with descriptions of processes for making such materials. U.S. Pat. No. 3,700,623, issued to Keim on Oct. 24, 1972 and U.S. Pat. No. 3,772,076, issued to Keim on Nov. 13, 1973 are examples of such patents and both are incorporated herein by reference.

Polyamide-epichlorohydrin resins sold under the trademarks Kymene 557H and Kymene 2064 by Hercules Incorporated of Wilmington, Del., are particularly useful in this invention. These resins are generally described in the aforementioned patents to Keim.

Base-activated polyamide-epichlorohydrin resins useful in the present invention are sold under the Santo Res trademark, such as Santo Res 31, by Monsanto Company of St. Louis, Mo. These types of materials are generally described in U.S. Pat. No. 3,855,158 issued to Petrovich on Dec. 17, 1974; U.S. Pat. No. 3,899,388 issued to Petrovich on Aug. 12, 1975; U.S. Pat. No. 4,129,528 issued to Petrovich on Dec. 12, 1978; U.S. Pat. No. 4,147,586 issued to Petrovich on Apr. 3, 1979; and U.S. Pat. No. 4,222,921 issued to Van Eenam on Sep. 16, 1980, the disclosure of each of which is incorporated herein by reference.

Other water-soluble cationic resins useful herein are the polyacrylamide resins such as those sold under the Parez trademark, such as Parez 631NC, by Cytec of Stanford, Conn. These materials are generally described in U.S. Pat. No. 3,556,932 issued to Coscia et al. on Jan. 19, 1971; and U.S. Pat. No. 3,556,933 issued to Williams et al. on Jan. 19, 1971, the disclosure of each of which is incorporated herein by reference.

Other types of water-soluble resins useful in the present invention include acrylic emulsions and anionic styrene-butadiene latexes. Numerous examples of these types of resins are provided in U.S. Pat. No. 3,844,880, Meisel, Jr. et al., issued Oct. 29, 1974, incorporated herein by reference. Still other water-soluble cationic resins finding utility in this invention are the urea formaldehyde and melamine formaldehyde resins. These polyfunctional, reactive polymers have molecular weights on the order of a few thousand. The more common functional groups include nitrogen containing groups such as amino groups and methylol groups attached to nitrogen.

Although less preferred, polyethylenimine type resins find utility in the present invention.

More complete descriptions of the aforementioned water-soluble resins, including their manufacture, can be found in TAPPI Monograph Series No. 29, Wet Strength In Paper and Paperboard. Technical Association of the Pulp and Paper Industry (New York; 1965), incorporated herein by reference. As used herein, the term "permanent wet strength resin" refers to a resin which allows the paper sheet, when placed in an aqueous medium, to keep a majority of its initial wet strength for a period of time greater than at least two minutes.

The above-mentioned wet strength additives typically result in paper products with permanent wet strength, i.e., paper which when placed in an aqueous medium retains a substantial portion of its initial wet strength over time. However, permanent wet strength in some types of paper products can be an unnecessary and undesirable property. Paper products such as toilet tissues, etc., are generally disposed of after brief periods of use into septic systems and the like. Clogging of these systems can result if the paper product permanently retains its hydrolysis-resistant strength properties.

More recently, manufacturers have added temporary wet strength additives to paper products for situations where wet strength is sufficient for the intended use, but where wet strength decay upon soaking in water is desirable. For example, decay of the wet strength facilitates flow of the paper product through septic systems. If wet strength is imparted to these products, it is preferred to be fugitive wet strength, characterized by a decay of part or all of its potency upon standing in presence of water. If fugitive wet strength is desired, the binder materials can be chosen from the group consisting of dialdehyde starch or other resins with aldehyde functionality such as Co-Bond 1000® offered by National Starch and Chemical Company, Parez 750® offered by Cytec of Stamford, Conn. and the resin described in U.S. Pat. No. 4,981,557 issued on Jan. 1, 1991, to Bjorkquist and incorporated herein by reference.

With respect to the classes and specific examples of both permanent and temporary wet strength resins listed above, it should be understood that the resins listed are exemplary in nature and are not meant to limit the scope of this invention.

Mixtures of compatible wet strength resins can also be used in the practice of this invention.

Antimigration Material

The antimigration material serves to minimize migration of the emollient lotion (discussed below) away from the surface of the tissue web on which it has been disposed. The Applicants have found that, by providing the tissue web with a suitable antimigration material prior to deposition of the emollient lotion, migration of the emollient lotion into the tissue web is substantially reduced. Without being bound by theory, the Applicants believe that treatment of the tissue web with a suitable antimigration material alters the wettability tension of the surface of the papermaking fibers thereof so as to minimize or even eliminate wetting thereof by the emollient lotion. As used herein, a surface having a suitable "wettability tension" will cause a liquid deposited thereon to have a contact angle greater than about 75°. Preferably, the contact angle is greater than about 80°, more preferably greater than about 85°. As is well known, high contact angles imply low wettability. Thus, when the emollient lotion is applied from the melt (as will be described below) to a papermaking surface that has been treated with a suitable antimigration material, the low wettability of the treated surface impedes migration of the melted lotion into the treated web so as to allow the molten emollient lotion to "set up" which further impedes migration. As will become clear from the examples, this reduced migration provides enhanced transfer of the lotion away from the surface of the treated tissue web to a user's skin. That is, given a specific lotion application weight, more of the applied lotion will remain on or adjacent to the surface of a tissue web that has been provided with an antimigration material than will remain on or adjacent to the surface of a tissue web that has not been so provided.

Suitable antimigration materials include those materials known to provide a low critical surface tension to surfaces when they are applied to a surface. Exemplary materials include, but are not limited to: fluorocarbon materials; silicone materials; reactive paper sizing materials, such as alkylketene dimers, substituted cyclic acid anhydrides, organically modified ceramic materials (ormocers), substituted long chain alkanes and alkenes, and chemical derivatives thereof wherein such derivatives enhance the substantively of such materials to papermaking fibers. Suppliers of suitable materials include: Hercules, Inc. of Wilmington, Del., National Starch and Chemical of Bridgewater, N.J, 3M of St. Paul, Minn., and DuPont of Wilmington, Del.

Quaternary Ammonium Compound

A particularly preferred antimigration material is a quaternary ammonium compound having the formula:

$$(R^1)_{4-m}—N^+—[R^2]_mX^-$$

wherein:

m is 1 to 3;

each $R^1$ is a $C_1$–$C_6$ alkyl group, hydroxyalkyl group, hydrocarbyl or substituted hydrocarbyl group, alkoxylated group, benzyl group, or mixtures thereof, each $R^2$ is a $C_{14}$–$C_{22}$ alkyl group, hydroxyalkyl group, hydrocarbyl or substituted hydrocarbyl group, alkoxylated group, benzyl group, or mixtures thereof, and $X^-$ is any softener-compatible anion are suitable for use in the present invention.

Preferably, each $R^1$ is methyl and $X^-$ is chloride or methyl sulfate. Preferably, each $R^2$ is $C_{16}$–$C_{18}$ alkyl or alkenyl, more preferably each $R^2$ is straight-chain $C_{18}$ alkyl or alkenyl. Most preferably, each $R^2$ is straight chain $C_{18}$ alkyl. Optionally, the $R^2$ substituent can be derived from vegetable oil (e.g. coconut oil) or animal (e.g. tallow) sources.

As used above, "coconut" refers to the alkyl and alkylene moieties derived from coconut oil. It is recognized that coconut oil is a naturally occurring mixture having, as do all naturally occurring materials, a range of compositions. Coconut oil contains primarily fatty acids (from which the alkyl and alkylene moieties of the quaternary ammonium salts are derived) having from 12 to 16 carbon atoms, although fatty acids having fewer and more carbon atoms are also present. Swern, Ed in Bailey's Industrial Oil and Fat Products, Third Edition, John Wiley and Sons (New York 1964) in Table 6.5, suggests that coconut oil typically has from about 65 to 82% by weight of its fatty acids in the 12 to 16 carbon atoms range with about 8% of the total fatty acid content being present as unsaturated molecules. The principle unsaturated fatty acid in coconut oil is oleic acid. Synthetic as well as naturally occurring "coconut" mixtures fall within the scope of this invention.

Tallow, as is coconut, is a naturally occurring material having a variable composition. Table 6.13 in the above-identified reference edited by Swern indicates that typically 78% or more of the fatty acids of tallow contain 16 or 18 carbon atoms. Typically, half of the fatty acids present in tallow are unsaturated, primarily in the form of oleic acid. Synthetic as well as natural "tallows" fall within the scope of the present invention.

Examples of quaternary ammonium compounds suitable for use in the present invention include the well-known dialkyldimethylammonium salts such as ditallowdimethylammonium chloride, ditallowdimethylammonium methylsulfate, di(hydrogenated tallow)dimethylammonium chloride; with di(hydrogenated tallow)dimethylammonium methylsulfate being preferred. This particular material is available commercially from Witco Chemical Company Inc. of Dublin, Ohio as Varisoft 137®.

Alternative preferred variants of these softening agents are what are considered to be mono or diester variations of these quaternary ammonium compounds having the formula:

$$(R^1)_{4-m}—N^+—[(CH_2)_n—Y—R^3]_mX^-$$

wherein:

Y is —O—(O)C—, or —C(O)—O—, or —NH—C(O)—, or —C(O)—NH—;

m is 1 to 3;

n is 0 to 4;

each $R^1$ is a $C_1$–$C_6$ alkyl group, hydroxyalkyl group, hydrocarbyl or substituted hydrocarbyl group, alkoxylated group, benzyl group, or mixtures thereof;

each $R^3$ is a $C_{13}$–$C_{21}$ alkyl group, hydroxyalkyl group, hydrocarbyl or substituted hydrocarbyl group, alkoxylated group, benzyl group, or mixtures thereof; and $X^-$ is any softener-compatible anion.

Preferably, Y=—O—(O)C—, or —C(O)—O—; m=2; and n=2. Each $R^1$ substituent is preferably a $C_1$–$C_3$, alkyl group, with methyl being most preferred. Preferably, each $R^3$ is $C_{13}$–$C_{17}$ alkyl and / or alkenyl, more preferably $R^3$ is straight chain $C_{15}$–$C_{17}$ alkyl and / or alkenyl, $C_{15}$–$C_{17}$ alkyl, most preferably each $R^3$ is straight-chain $C_{17}$ alkyl. Optionally, the $R^3$ substituent can be derived from vegetable oil sources.

As mentioned above, $X^-$ can be any softener-compatible anion, for example, acetate, chloride, bromide, methyl sulfate, formate, sulfate, nitrate and the like can also be used in the present invention. Preferably $X^-$ is chloride or methyl sulfate.

Specific examples of ester-functional quaternary ammonium compounds having the structures named above and suitable for use in the present invention include the well-known diester dialkyl dimethyl ammonium salts such as diester ditallow dimethyl ammonium chloride, monoester ditallow dimethyl ammonium chloride, diester ditallow dimethyl ammonium methyl sulfate, diester di(hydrogenated) tallow dimethyl ammonium methyl sulfate, diester di(hydrogenated)tallow dimethyl ammonium chloride, and mixtures thereof. Diester ditallow dimethyl ammonium chloride and diester di(hydrogenated)tallow dimethyl ammonium chloride are particularly preferred. These particular materials are available commercially from Witco Chemical Company Inc. of Dublin, Ohio under the tradename "ADOGEN SDMC".

Preferably such quaternary ammonium compounds are present in the tissue web at a level between about 0.01% to about 4.0%, more preferably from about 0.03% to about 1.0% by weight, on a dry fiber weight basis. The method of adding such materials is discussed below.

Polyhydroxy Plasticizer

The present invention also optionally contains from about 0.01% to about 4.0%, more preferably from about 0.03% to about 1.0% by weight, on a dry fiber weight basis, of a polyhydroxy plasticizer. Without being bound by theory, it is believed that the plasticizer enhances the flexibility of the cellulosic fibers and acts to stabilize the quaternary ammonium compound in the aqueous solution. Such materials are also useful as process aids during the production of certain quaternary ammonium compounds.

Examples of polyhydroxy plasticizers useful in the present invention include glycerol and polyethylene glycols having a molecular weight of from about 200 to about 2000, with polyethylene glycols having a molecular weight of from about 200 to about 600 being preferred.

A particularly preferred polyhydroxy plasticizer is polyethylene glycol having a molecular weight of about 400. This material is available commercially from the Union Carbide Company of Danbury, Conn. under the tradename "PEG-400".

Optional Furnish Ingredients

Other chemicals commonly used in papermaking can be added to the papermaking furnish so long as they do not significantly and adversely affect the softening, absorbency, and wet strength enhancing actions of the three required chemicals.

For example, surfactants may be used to treat the tissue paper webs of the present invention. The level of surfactant, if used, is preferably from about 0.01% to about 2.0% by weight, based on the dry fiber weight of the tissue paper. The surfactants preferably have alkyl chains with eight or more carbon atoms. Exemplary anionic surfactants are linear alkyl sulfonates, and alkylbenzene sulfonates. Exemplary nonionic surfactants are alkylglycosides including alkylglycoside esters such as Crodesta™ SL-40 which is available from Croda, Inc. (New York, N.Y.); alkylglycoside ethers as described in U.S. Pat. No. 4,011,389, issued to W. K. Langdon, et al. on Mar. 8, 1977; and alkylpolyethoxylated esters such as Pegosperse™ 200 ML available from Glyco Chemicals, Inc. (Greenwich, Conn.) and IGEPAL RC-520 available from Rhone Poulenc Corporation (Cranbury, N.J.).

Other types of chemicals which may be added include dry strength additives to increase the tensile strength of the tissue webs. Examples of dry strength additives include carboxymethyl cellulose, and cationic polymers from the ACCO chemical family such as ACCO 771 and ACCO 514, with carboxymethyl cellulose being preferred. This material is available commercially from the Hercules Company of Wilmington, Del. under the tradename HERCULES® CMC. The level of dry strength additive, if used, is preferably from about 0.01% to about 1.0%, by weight, based on the dry fiber weight of the tissue paper.

The above listings of additional chemical additives is intended to be merely exemplary in nature, and are not meant to limit the scope of the invention.

Papermaking Furnish Preparation

The papermaking furnish can be readily formed or prepared by mixing techniques and equipment well known to those skilled in the papermaking art.

The three types of chemical ingredients described above (necessarily, the antimigration material (e.g. a quaternary ammonium compound) and, optionally, polyhydroxy plasticizer and water soluble permanent wet strength resin) are preferably added to the aqueous slurry of papermaking fibers, or furnish in the wet end of the papermaking machine at some suitable point ahead of the Fourdrinier wire or sheet forming stage. However, applying the above identified chemical ingredients subsequent to formation of a wet tissue web and prior to application of the emollient lotion will also provide significant benefits and such methods are expressly included within the scope of the present invention.

It has been discovered that the chemical ingredients are more effective when the quaternary ammonium compound and the polyhydroxy plasticizer are first pre-mixed together before being added to the papermaking furnish. A preferred method consists of first heating the polyhydroxy plasticizer to a temperature of about 150° F. (65° C.) and then adding the preferred quaternary ammonium compound to the hot plasticizer to form a fluidized "melt". Preferably, only the minimum amount of the polyhydroxy compound necessary to create a stable vesicle suspension of the quaternary ammonium compound should be used. The ratio of the quaternary ammonium compound to the plasticizer will vary depending upon the molecular weight of the particular plasticizer and/or quaternary ammonium compound used. The Applicants believe that the mixture of quaternary ammonium compound and polyhydroxy plasticizer should contain at least about 10% by weight polyhydroxy plasticizer, preferably at least about 20% by weight. The quaternary ammonium compound and polyhydroxy plasticizer melt is then diluted to the desired concentration, and mixed to form an aqueous solution containing a vesicle suspension of the quaternary ammonium compound/polyhydroxy plasticizer mixture which is then added to the papermaking furnish.

If desired, the permanent wet strength resins are also diluted to the appropriate concentration and added to the papermaking furnish.

Tissue Web Formation

The second step in the process of this invention is the depositing of the papermaking furnish on a foraminous surface and the third is the removing of the water from the furnish so deposited. Techniques and equipment which can be used to accomplish these two processing steps will be readily apparent to those skilled in the papermaking art.

The present invention is applicable to tissue paper in general, including but not limited to conventionally felt-pressed tissue paper; pattern densified tissue paper such as exemplified in the aforementioned U.S. Patent by Sanford-Sisson and its progeny; and high bulk, uncompacted tissue paper such as exemplified by U.S. Pat. No. 3,812,000, Salvucci, Jr., issued May 21, 1974. The tissue paper may be of a homogenous or multilayered construction; and tissue paper products made therefrom may be of a single-ply or multi-ply construction. The tissue paper preferably has a basis weight of between 10 g/m$^2$ and about 65 g/m$^2$, and density of about 0.60 g/cc or less. Preferably, the basis weight will be below about 35 g/m$^2$ (or even less); and the density will be about 0.30 g/cc (or even less). Most preferably, the density will be between about 0.04 g/cc and about 0.20 g/cc.

Conventionally pressed tissue paper and methods for making such paper are known in the art. Such paper is typically made by depositing papermaking furnish on a foraminous forming wire. This forming wire is often referred to in the art as a Fourdrinier wire. Once the furnish is deposited on the forming wire, it is referred to as a web. The web is dewatered by pressing the web and drying at elevated temperature. The particular techniques and typical equipment for making webs according to the process just described are well known to those skilled in the art. In a typical process, a low consistency pulp furnish is provided in a pressurized headbox. The headbox has an opening for delivering a thin deposit of pulp furnish onto the Fourdrinier wire to form a wet web. The web is then typically dewatered to a fiber consistency of between about 7% and about 25% (total web weight basis) by vacuum dewatering and further dried by pressing operations wherein the web is subjected to pressure developed by opposing mechanical members, for example, cylindrical rolls. The dewatered web is then further pressed and dried by a stream drum apparatus known in the art as a Yankee dryer. Pressure can be developed at the Yankee dryer by mechanical means such as an opposing cylindrical drum pressing against the web. Multiple Yankee dryer drums may be employed, whereby additional pressing is optionally incurred between the drums. The tissue paper structures which are formed are referred to hereinafter as conventional, pressed, tissue paper structures. Such sheets are considered to be compacted since the web is subjected to substantial mechanical compressional forces while the fibers are moist and are then dried (and optionally creped) while in a compressed state.

Pattern densified tissue paper is characterized by having a relatively high bulk field of relatively low fiber density and an array of densified zones of relatively high fiber density. The high bulk field is alternatively characterized as a field of pillow regions. The densified zones are alternatively referred to as knuckle regions. The densified zones may be discretely spaced within the high bulk field or may be interconnected, either fully or partially, within the high bulk field. Preferred processes for making pattern densified tissue webs are disclosed in U.S. Pat. No. 3,301,746, issued to Sanford and Sisson on Jan. 31, 1967, U.S. Pat. No. 3,974,025, issued to Peter G. Ayers on Aug. 10, 1976, and U.S. Pat. No. 4,191,609, issued to Paul D. Trokhan on Mar. 4, 1980, and U.S. Pat. No. 4,637,859, issued to Paul D. Trokhan on Jan. 20, 1987; the disclosure of each of which is incorporated herein by reference.

In general, pattern densified webs are preferably prepared by depositing a papermaking furnish on a foraminous forming wire such as a Fourdrinier wire to form a wet web and then juxtaposing the web against an array of supports. The web is pressed against the array of supports, thereby resulting in densified zones in the web at the locations geographically corresponding to the points of contact between the array of supports and the wet web. The remainder of the web not compressed during this operation is referred to as the high bulk field. This high bulk field can be further dedensified by application of fluid pressure, such as with a vacuum type device or a blow-through dryer, or by mechanically pressing against the array of supports. The web is dewatered, and optionally predried, in such a manner so as to substantially avoid compression of the high bulk field. This is preferably accomplished by fluid pressure, such as with a vacuum type device or blow-through dryer, or alternately by mechanically pressing the web against an array of supports wherein the high bulk field is not compressed. The operations of dewatering, optional predrying and formation of the densified zones may be integrated or partially integrated to reduce the total number of processing steps performed. Subsequent to formation of the densified zones, dewatering, and optional predrying, the web is dried to completion, preferably still avoiding mechanical pressing. Preferably, from about 8% to about 55% of the tissue paper surface comprises densified knuckles having a relative density of at least 125% of the density of the high bulk field.

The array of supports is preferably an imprinting carrier fabric having a patterned displacement of knuckles which operate as the array of supports which facilitate the formation of the densified zones upon application of pressure. The pattern of knuckles constitutes the array of supports previously referred to. Imprinting carrier fabrics are disclosed in U.S. Pat. No. 3,301,746, Sanford and Sisson, issued Jan. 31, 1967, U.S. Pat. No. 3,821,068, Salvucci, Jr. et al., issued May 21, 1974, U.S. Pat. No. 3,974,025, Ayers, issued Aug. 10, 1976, U.S. Pat. No. 3,573,164, Friedberg et al., issued Mar. 30, 1971, U.S. Pat. No. 3,473,576, Amneus, issued Oct. 21, 1969, U.S. Pat. No. 4,239,065, Trokhan, issued Dec. 16, 1980, and U.S. Pat. No. 4,528,239, Trokhan, issued Jul. 9, 1985, the disclosure of each of which is incorporated herein by reference.

Preferably, the furnish is first formed into a wet web on a foraminous forming carrier, such as a Fourdrinier wire. The web is dewatered and transferred to an imprinting fabric. The furnish may alternately be initially deposited on a foraminous supporting carrier which also operates as an imprinting fabric. Once formed, the wet web is dewatered and, preferably, thermally predried to a selected fiber consistency of between about 40% and about 80%. Dewatering can be performed with suction boxes or other vacuum devices or with blow-through dryers. The knuckle imprint of the imprinting fabric is impressed in the web as discussed above, prior to drying the web to completion. One method for accomplishing this is through application of mechanical pressure. This can be done, for example, by pressing a nip roll which supports the imprinting fabric against the face of a drying drum, such as a Yankee dryer, wherein the web is disposed between the nip roll and drying drum. Also, preferably, the web is molded against the imprinting fabric prior to completion of drying by application of fluid pressure with a vacuum device such as a suction box, or with a blow-through dryer. Fluid pressure may be applied to induce impression of densified zones during initial dewatering, in a separate, subsequent process stage, or a combination thereof.

Uncompacted, nonpattern-densified tissue paper structures are described in U.S. Pat. No. 3,812,000 issued to Joseph L. Salvucci, Jr. and Peter N. Yiannos on May 21, 1974 and U.S. Pat. No. 4,208,459, issued to Henry E. Becker, Albert L. McConnell, and Richard Schutte on Jun. 17, 1980, both of which are incorporated herein by reference. In general, uncompacted, nonpattern-densified tissue paper structures are prepared by depositing a papermaking furnish on a foraminous forming wire such as a Fourdrinier wire to form a wet web, draining the web and removing additional water without mechanical compression until the web has a fiber consistency of at least 80%, and creping the web. Water is removed from the web by vacuum dewatering and thermal drying. The resulting structure is a soft but weak high bulk sheet of relatively uncompacted fibers. Bonding material is preferably applied to portions of the web prior to creping.

Compacted non-pattern-densified tissue structures are commonly known in the art as conventional tissue structures. In general, compacted, non-pattern-densified tissue paper structures are prepared by depositing a papermaking furnish on a foraminous wire such as a Fourdrinier wire to form a wet web, draining the web and removing additional water with the aid of a uniform mechanical compaction (pressing) until the web has a consistency of 25–50%, transferring the web to a thermal dryer such as a Yankee and creping the web. Overall, water is removed from the web by vacuum, mechanical pressing and thermal means. The resulting structure is strong and generally of singular density, but very low in bulk, absorbency and in softness.

While the characteristics of the creped paper webs, particularly when the creping process is preceded by methods of pattern densification, are preferred for practicing the present invention, uncreped tissue paper is also a satisfactory substitute and the practice of the present invention using uncreped tissue paper is specifically incorporated within the scope of the present invention. Uncreped tissue paper, a term as used herein, refers to tissue paper which is non-compressively dried, most preferably by throughdrying. The techniques to produce such uncreped tissue are taught in the prior art. For example, Wendt, et. al. in European Patent Application 0 677 612A2, published Oct. 18, 1995 and Farrington, Jr., et al. in U.S. Pat. No. 5,607,551, issued Mar. 4, 1997, the disclosure of each being incorporated herein by reference, teach a method of making soft tissue products without creping. In another case, Hyland, et. al. in European Patent Application 0 617 164 A1, published Sep. 28, 1994 and incorporated herein by reference, teach a method of making smooth uncreped throughdried sheets.

Emollient Lotion

Lotion Composition

The second necessary element of the present invention is an emollient lotion. As used in this specification, an emollient lotion is a material which softens, soothes, supples, coats, lubricates, moisturizes, or cleanses the skin. In preferred embodiments of the present invention, the emollient lotion accomplishes several of these objectives such as soothing, moisturizing, and lubricating the skin. Dake, et al, Buchalter, and Weiss, et al, in the aforementioned U.S. patents, all three of which are incorporated herein by reference, describe emollients which can be used in the practice of the present invention as long as a suitable antimigration material is also provided.

The emollient lotion of the present invention can comprise: 1) from about 51% to about 81% by weight of a hydrocarbon emollient, such as mineral oil, petrolatum or a hydrocarbon wax; 2) from about 14% to about 34% of an immobilizing agent which helps to minimize the tendency of the emollient to migrate, such as fatty alcohols, fatty amides, and mixtures thereof, and 3) from about 5% to about 15% of a low HLB (less than about 6) emulsifier to help compatibilize the hydrocarbon emollient and the immobilizing agent. An especially preferred emollient lotion is shown in Table 1:

TABLE 1

| Component | Percent |
|---|---|
| Hydrocarbon Emollient | |
| Mineral Oil[1] | 55 |
| Paraffin[2] | 12 |
| Immobilizing Agent | |
| Cetaryl Alcohol[3] | 21 |
| Emulsifier | |
| Steareth-2[4] | 11 |
| Minor Ingredients | 1 |
| | 100 |

[1]Available from Witco, Petrolina, PA
[2]Available from Dussek & Campbell, National Wax Division, Houston, TX
[3]Available from Procter & Gamble, Cincinnati, OH as TA1618
[4]Available from ICI Surfactants, Wilmington, DE as Brij 72

The emollient can be applied to the substrate by any convenient technique such as spraying, dipping, padding, printing, or, in the case of the preferred emollient and other substances having similar physical properties, by extrusion of the melted emollient onto the substrate (discussed in detail below).

The emollient is applied at least to one surface of the substrate. Preferably, the emollient is applied to both major surfaces of the substrate. It can be applied to the substrate at any convenient level. The preferred emollient is applied to the substrate at a level of from about 0.8 g/m$^2$ to about 8 g/m$^2$ to at least one side of the preferred laminate substrate. More preferably, the emollient is applied at a level between about 2 g/m$^2$ and about 5 g/m$^2$ to at least one side of the preferred laminate substrate. Preferably, the emollient is essentially uniformly distributed over a major portion of at least one side of the preferred laminate substrate.

Lotion Treatment

The emollient can be applied to the substrate by any convenient technique such as spraying, dipping, padding, or printing. For example, the emollient lotion can be printed in a pattern of uniform discrete surface deposits using means known to the art such as printing the melted emollient lotion using a gravure cylinder engraved with the desired pattern. Such a method of printing an emollient lotion of the present invention is described in greater detail in U.S. patent application Ser. No. 08/777,829, filed in the name of Vinson, et al. the disclosure of which is incorporated herein by reference.

Preferably, in the case of the preferred emollient lotion discussed above and other substances having similar physical properties, the emollient lotion is deposited on the tissue substrate by extrusion of the melted emollient onto the substrate as is described below Referring to FIG. 1, a dried tissue web 101 is unwound from parent tissue roll 102 (rotating in the direction indicated by arrow 102*a*) and then advanced around turning roll 104. From turning roll 104, web 101 is advanced to slot extrusion coating station 106 where the lotion composition is then applied to both sides of the web. After leaving station 106, web 101 becomes a lotioned web indicated by 103. Lotioned web 103 is then wound up on lotioned tissue parent roll 110 (rotating in the direction indicated by arrow 110*a*). Station 106 comprises a pair of spaced slot extruders 112 and 114. Extruder 112 has an elongated slot 116 and a web contacting surface 118; extruder 114 similarly has an elongated slot 120 and a web contacting surface 122. As shown in FIG. 2, extruders 112 and 114 are oriented such that surface 118 is in contact with one side of web 101, while surface 122 is in contact with the other side of web 101. Hot, molten (e.g., about 65° C.) lotion composition is pumped to each of extruders 112 and 114 and is then extruded through slots 116 and 120, respectively. As web 101 passes over the heated surface 118 of extruder 112 and reaches slot 116, the molten lotion composition extruded from slot 116 is applied to the side of web 101 in contact with surface 118. Similarly, as web 101 passes over heated surface 122 of extruder 114 and reaches slot 120, the molten lotion composition extruded from slot 120 is applied to the side of web 101 in contact with surface 122. The amount of lotion composition transferred to web 101 is controlled by: (1) the rate at which the molten lotion composition is extruded from slots 116 and 122; and/or (2) the speed at which web 101 travels while in contact with surfaces 118 and 122.

The treated tissue paper web of this invention can be used in any application where soft tissue paper webs are required. One particularly advantageous use of the tissue paper web of this invention is in wipes or facial tissue products. For example, the enhanced lotion transfer can be used to deliver additional active ingredients to nasal area from a single facial tissue or the enhanced lotion transfer can deliver additional emollient lotion to the user's nasal area.

TEST METHODS

Quaternary Ammonium Compound Level on Tissue

The following method is appropriate for determining the quantity of the preferred quaternary ammonium compounds (QAC) that may incorporated into the tissue web by the method of the present invention. A standard anionic surfactant (sodium dodecylsulfate—NaDDS) solution is used to titrate the QAC using a dimidium bromide indicator.

Preparation of Standard Solutions

The following methods are applicable for the preparation of the standard solutions used in this titration method.

Preparation of Dimidium Bromide Indicator

To a 1 liter volumetric flask:

A) Add 500 milliliters of distilled water.

B) Add 40 ml. of dimidium bromide-disulphine blue indicator stock solution, available from Gallard-Schlesinger Industries, Inc. of Carle Place, N.Y.

C) Add 40 ml. of 5N $H_2SO_4$

D) Fill flask to the mark with distilled water and mix.

Preparation of the NaDDS solution to a 1 liter volumetric flask:

A) Weigh 0.1154 grams of NaDDS available from Aldrich Chemical Co. of Milwaukee, Wis. as sodium dodecyl sulfate (ultra pure).

B) Fill flask to mark with distilled water and mix to form a 0.0004N solution.

Method

1. On an analytical balance, weigh approximately 0.5 grams of tissue. Record the sample weight to the nearest 0.1 mg.
2. Place the sample in a glass cylinder having a volume of about 150 milliliters which contains a star magnetic stirrer. Using a graduated cylinder, add 20 milliliters of methylene chloride.
3. In a fume hood, place the cylinder on a hot plate turned to low heat. Bring the solvent to a full boil while stirring and using a graduated cylinder, add 35 milliliters of dimidium bromide indicator solution.
4. While stirring at high speed, bring the methylene chloride to a full boil again. Turn off the heat, but continue to stir the sample. The QAC will complex with the indicator forming a blue colored compound in the methylene chloride layer.
5. Using a 10 ml. burette, titrate the sample with a solution of the anionic surfactant. This is done by adding an aliquot of titrant and rapidly stirring for 30 seconds. Turn off the stir plate, allow the layers to separate, and check the intensity of the blue color. If the color is dark blue add about 0.3 milliliters of titrant, rapidly stir for 30 seconds and turn off stirrer. Again check the intensity of the blue color. Repeat if necessary with another 0.3 milliliters When the blue color starts to become very faint, add the titrant dropwise between stirrings. The endpoint is the first sign of a slight pink color in the methylene chloride layer.
6. Record the volume of titrant used to the nearest 0.05 ml.
7. Calculate the amount of QAC in the product using the equation:

$$\frac{(\text{milliliters of NaDDS} - X) * Y * 2}{\text{Sample weight in grams}} = \#/\text{ton QAC}$$

Where X is a blank correction obtained by titrating a specimen without the QAC of the present invention. Y is the milligrams of QAC that 1.00 milliliters of NaDDS will titrate. (For example, Y=0.254 for one particularly preferred QAC, i.e. diestherdi(touch-hydrogenated)tallow dimethyl chloride.)

Density

The density of multi-layered tissue paper, as that term is used herein, is the average density calculated as the basis weight of that paper divided by the caliper, with the appropriate unit conversions incorporated therein. Caliper of the multi-layered tissue paper, as used herein, is the thickness of the paper when subjected to a compressive load of 95 g/in$^2$ (15.5 g/cm$^2$).

Lotion Transfer

The amount of lotion transferred from a treated tissue product is determined with a Sutherland Rub Tester (available from Testing Machines, Inc. of Amityville, N.Y.). This tester uses a motor to rub a sample of the treated tissue 5 times over an impervious transfer surface. Any lotion transferred from the treated tissue is extracted from the transfer surface and the quantity transferred is determined using gas chromatographic methods.

Sample Preparation

Prior to the lotion transfer testing, the paper samples to be tested should be conditioned according to TAPPI Method #T402OM-88. Here, samples are preconditioned for 24 hours at a relative humidity level of 10 to 35% and within a temperature range of 22 to 40° C. After this preconditioning step, samples should be conditioned for 24 hours at a relative humidity of 48 to 52% and within a temperature range of 22 to 24° C. Transfer testing should also take place within the confines of the constant temperature and humidity room.

Obtain a 30" (76 cm)×40" (101 cm) piece of Crescent #300 cardboard from Cordage Inc. of Cincinnati, Ohio. Using a paper cutter, cut out six pieces of cardboard of dimensions of 2.25"×7.25" (5.7 cm×18.4 cm). Draw two lines parallel to the short dimension and down 1.125" (2.9 cm) from the top and bottom most edges on the white side of the cardboard. Carefully score the length of the line with a razor blade using a straight edge as a guide. Score it to a depth about half way through the thickness of the sheet. This scoring allows the cardboard/felt combination to fit tightly around the weight of the Sutherland Rub tester. Draw an arrow running parallel to the long dimension of the cardboard on this scored side of the cardboard.

Cut the six pieces of black felt (F-55 or equivalent from New England Gasket of Bristol, Conn.) to the dimensions of 2.25"×8.5"×0.0625" (5.7 cm×21.6 cm×1.6 cm). Place the felt on top of the unscored, green side of the cardboard such that the long edges of both the felt and cardboard are parallel and in alignment. Make sure the fluffy side of the felt is facing up. Also allow about 0.5" (1.3 cm) to overhang the top and bottom most edges of the cardboard. Cut a tissue sample to the same dimensions as the felt and center it on the felt. Snugly fold the overhanging edges and tape (Scotch™ tape from 3M, St. Paul, Minn. is suitable) the sample and the felt to the back of the cardboard to complete preparation of a felt/cardboard/tissue sample.

Care of 4 Pound Weight

The 4 pound (1.8 kilogram) weight has 4 cm$^2$ (26 cm$^2$) of effective contact area providing a contact pressure of 1 psi (6.8 kPa). Since the contact pressure can be changed by alteration of the rubber pads mounted on the face of the weight, it is important to use only the rubber pads supplied by the manufacturer (Brown Inc., Mechanical Services Department, Kalamazoo, Mich.). These pads must be replaced if they become hard, abraded or chipped off.

When not in use, the weight must be positioned such that the pads are not supporting the full weight of the weight. It is best to store the weight on its side.

Measurement of Samples

For the measurement of the actual tissue paper/cardboard combinations, place the transfer surface (glass mirror) on the base plate of the tester positioning the mirror against the hold-down pins. The hold-down pins prevent the mirror from moving during the test.

Clip the calibration felt/cardboard/tissue sample onto the four pound weight with the cardboard side contacting the pads of the weight. Make sure the cardboard/felt/tissue combination is resting flat against the weight. Hook this weight onto the tester arm. The felt/cardboard/tissue sample must rest flat on the mirror and must be in 100% contact with the mirror surface.

Next, activate the tester by depressing the "push" button. At the end of the five strokes the tester will automatically stop.

Remove the weight with the felt covered cardboard. Inspect the tissue sample. If torn, discard the felt and tissue and start over. If the tissue sample is intact, remove the felt covered cardboard from the weight. Repeat with an additional three felt/cardboard/tissue samples to insure sufficient lotion has been transferred for accurate measurement.

Repeat the above steps to generate six replicates for each test condition.

After all conditions have been measured, remove and discard all felt. Felts strips are not used again. Cardboard supports are used until they are bent, torn, limp, or no longer have a smooth surface.

Extraction and Analysis

Each mirror is washed once with a four milliliter aliquot of toluene into a beaker. The extract is transferred to a sample vial and dried down using dry nitrogen. The mirror is washed a second time with a two milliliter aliquot of toluene, the liquid transferred and dried as described above.

One milliliter of toluene is then added to each sample vial before sealing the vial. The vials are then gently agitated to dissolve the transferred mirror extract. The level of stearyl alcohol in the dissolved extract is then measured using known gas chromatographic techniques.

Known standards are used, as is common in the art, to determine lotion recovery constants (for the washing and transfer steps) and to determine gas chromatograph equipment constants. The Applicants have found that the lotion recovery constant is about 0.34 (i.e. about 34% of a known amount of lotion was recovered from a mirror using the extraction steps described above). Gas chromatographic equipment constants will depend on the specific equipment setup chosen. One skilled in the chromatographic arts can readily choose an appropriate equipment setup to quantitatively determine the presence of stearyl alcohol in an extract.

The amount of stearyl alcohol chromatographically determined is divided by 0.34 to estimate the amount of stearyl alcohol on the mirror. The amount of emollient lotion on the mirror is then determined using the known concentration of stearyl alcohol in the emollient lotion. Results are reported in milligrams.

The following examples illustrate the practice of the present invention but is not intended to be limiting thereof.

EXAMPLE 1

The purpose of this example is to illustrate a method that can be used to make-up a composition comprising a mixture of di(hydrogenated)tallowdimethyl ammonium methyl sulfate (DHTDMAMS) and polyoxyethylene glycol 400 (PEG-400) that is suitable for adding the preferred antimigration material to the furnish of the tissue webs of the present invention.

The composition is prepared according to the following procedure: 1. An equivalent weight of DHTDMAMS and PEG-400 is weighed separately; 2. PEG is heated up to about 88° C. (190° F.); 3. DHTDMAMS is dissolved in the PEG to form a melted solution at 88° C. (190° F.); 4. Adequate mixing is provided to form a homogenous mixture of DHTDMAMS in PEG; 5. The homogenous mixture of (4) is cooled down to a solid form at room temperature.

For use, the composition is diluted to the desired concentration for use in a papermaking furnish.

EXAMPLE 2

The purpose of this example is to illustrate a method using blow through drying and layered paper making techniques to make soft and lint resistant multi-ply facial tissue paper treated with a quaternary ammonium compound composition comprising di(hydrogenated)tallowdimethyl ammonium methyl sulfate (DHTDMAMS) and polyoxyethylene glycol 400 (PEG-400), a permanent wet strength resin, and a dry strength resin.

A pilot scale Fourdrinier paper making machine is used in the practice of the present invention. First, the chemical softener composition is prepared according to the procedure in Example 1 wherein the homogenous premix of DHTDMAMS and polyhydroxy compounds in a solid state is re-melted at a temperature of about 88° C. (190° F.). The melted mixture is then dispersed in a conditioned water tank (temperature about 66° C.) to form a sub-micron vesicle dispersion. The particle size of the vesicle dispersion is determined using an optical microscopic technique. The particle size range is from about 0.1 to 1.0 micron.

Second, a 3% by weight aqueous slurry of northern softwood Kraft fibers is made up in a conventional re-pulper. The NSK slurry is refined gently and a 1% solution of the permanent wet strength resin (i.e. Kymene® 557H marketed by Hercules Incorporated of Wilmington, Del.) is added to the NSK stock pipe at a rate of 0.275% by weight of the dry fibers. The adsorption of the permanent wet strength resin onto NSK fibers is enhanced by an in-line mixer. A 0.5% solution of the dry strength resin (i.e. CMC from Hercules Incorporated of Wilmington, Del.) is added to the NSK stock before the fan pump at a rate of 0.15% by weight of the dry fibers. The NSK slurry is diluted to about 0.2% consistency at the fan pump.

Third, a 3% by weight aqueous slurry of Eucalyptus fibers is made up in a conventional re-pulper. A 1% solution of the permanent wet strength resin (i.e. Kymene® 557H) is added to the Eucalyptus stock pipe at a rate of 0.275% by weight of the dry fibers. A 1% solution of the quaternary ammonium compound mixture is added to the Eucalyptus stock pipe before the in-line mixer at a rate of 0.25% by weight of the dry fibers. The Eucalyptus slurry is diluted to about 0.2% consistency at the fan pump.

The individually treated furnish streams (stream 1=100% NSK/stream 2=100% Eucalyptus) are kept separate through the headbox and deposited onto a Fourdrinier wire to form a two layer embryonic web containing equal portions of NSK and Eucalyptus. Dewatering occurs through the Fourdrinier wire and is assisted by a deflector and vacuum boxes. The Fourdrinier wire is of a 5-shed, satin weave configuration having 105 machine-direction and 107 cross-machine-direction monofilaments per inch, respectively. The embryonic wet web is transferred from the Fourdrinier wire, at a fiber consistency of about 20% at the point of transfer, to a 59×44 fabric having a bilaterally staggered array of cavities (such fabrics are described in U.S. Pat. No. 4,239,065, issued to Trokhan on Dec. 16, 1980, the disclosure of which is incorporated herein by reference). Further de-watering is accomplished by vacuum assisted drainage until the web has a fiber consistency of about 28%. The patterned web is pre-dried by air blow-through to a fiber consistency of about 65% by weight. The web is then adhered to the surface of a Yankee dryer with a sprayed creping adhesive comprising 0.25% aqueous solution of Polyvinyl Alcohol (PVA). The fiber consistency is increased to an estimated 96% before dry creping the web with a doctor blade. The doctor blade has a bevel angle of about 25 degrees and is positioned with respect to the Yankee dryer to provide an impact angle of about 81 degrees; the Yankee dryer is operated at about 800 fpm (feet per minute) (about 244 meters per minute). The dry web is formed into roll at a speed of 680 fpm (208 meters per minutes).

EXAMPLE 3

This example is intended to describe the preparation of the preferred emollient lotion described in Table 1 above. The emollient lotion described in Table 1 can be prepared using a method comprising the following steps:

1) Preweigh each of the ingredients according to the composition of Table 1. Weights will depend on the desired amount of finished emollient lotion.
2) Heat the mineral oil, the cetaryl alcohol, and to Steareth-2 to at least a temperature greater than their melting point. The Applicants have found that heating to a temperature of about 140° F. (60° C.) is suitable for all of the ingredients requiring melting.
3) Preheat a mixing vessel having a suitable volume for containing the desired quantity of emollient lotion to a temperature of about 140° F. (60° C.). Any suitable means of heating the vessel can be used. For example, the vessel can be provided with a steam jacket or resistance heating with appropriate temperature control means.
4) Charge each of the preweighed, melted ingredients into the preheated vessel and blend using appropriate mixing. A propeller agitator is suitable.
5) Weigh and add the paraffin and continue mixing until the paraffin has melted and blended.
6) Add any minor ingredients that may be desired.

This composition may be kept in the melt until use or packed into an appropriate container(s) and cooled for later use.

EXAMPLE 4

This example is intended to demonstrate how the tissue webs prepared according to Example 2 can be treated with the preferred emollient lotion prepared according to Example 3 and converted into lotion treated facial tissue products.

1) Provide two parent rolls of tissue substrate prepared according to Example 2.
2) Unwind and laminate the tissue from each parent roll by knurling the longitudinal edges thereof to provide a web of laminated tissue substrate.
3) Coat each side of the web of laminated tissue substrate tissue with the emollient lotion of Example 3 using the apparatus shown in FIG. 1 and the slot extrusion method discussed above. The following process conditions are suitable:

Unwind Speed: 211 feet/minute (64 m/min)

Emollient Lotion Flow Rate: 0.16 pounds/minute (73 grams/min)

Extrusion Slot Gap: 0.004 inches (0.1 mm)

Extrusion Temperature: 130° F. (54° C.)

Rewind Speed: 225 feet/minute (69 m/min)

This process provides lotion to each side of the laminated tissue substrate at an add-on level of 3.2 g/m$^2$.

4) Slit, fold and sheet the coated web into a two-layer, two-ply facial tissue paper product using apparatus and methods as are known to the art. The multiply facial tissue paper has a tissue basis weight of about 20 pounds/3000 ft$^2$ (33 g/m$^2$) with about 3.9 pounds/3000 ft$^2$ (6.4 g/m$^2$) of emollient lotion disposed thereon. Importantly, the resulting multi-ply tissue paper is soft with good lint resistance and is suitable for use as facial tissues.

EXAMPLE 5

This example is intended to demonstrate the wettability tension of a suitable antimigration material for the preferred emollient lotion described in Table 1 and prepared according to Example 2.

The following procedure was followed:

1) A preferred antimigration material according to the present invention (a mixture of dihydrogenated tallow dimethyl ammonium methyl sulfate and polyethylene glycol 400) as described above) was melted and deposited into a petri dish. The melted antimigration material was allowed to cool and solidify.
2) The emollient lotion prepared according to Example 2 was heated to 160° F. (71° C.) and melted. A drop of the melted emollient lotion was placed on the solid antimigration material surface and allowed to solidify.
3) The contact angle between the solidified lotion droplet and the antimigration surface was measured using means known to the art (e.g. a goiniometer).
4) Five replicate experiments were conducted and the results are shown in Table 2.

TABLE 2

| Wettability Tension | |
|---|---|
| Trial | Contact Angle |
| 1 | 82° |
| 2 | 84° |
| 3 | 88° |
| 4 | 89° |
| 5 | 88° |
| Average | 86.2° |

As is clearly shown, the high contact angle means that there is minimal driving force for the preferred emollient lotion of the present invention to wet the preferred antimigration material of the present invention.

EXAMPLE 6

This example is intended to demonstrate the enhanced lotion transfer of the treated tissue paper products of the present invention that were prepared according to Example 4. The following procedure was used:

1) A control tissue web was prepared using the method of Example 2 with the exception that the papermaking furnish is not provided with an antimigration material.
2) The control tissue web was treated according to the method of Example 4 with the emollient lotion prepared according to Example 3 so as to provide a control sample which: 1) has an equivalent amount of emollient lotion as the treated tissue of the present invention and 2) does not have an antimigration material.

3) The treated control tissue web and the treated tissue web according to the present invention (Example 4) were both evaluated for lotion transfer according to the method described in the TEST METHODS section. The results of the evaluation are shown in Table 3.

TABLE 3

| Lotion Transfer | | |
|---|---|---|
| Sample Number | Control Tissue (mg) | Tissue of Example 4 (mg) |
| 1 | 0.509 | 1.134 |
| 2 | 0.486 | 1.101 |
| 3 | 0.406 | 1.419 |
| 4 | 0.509 | 1.199 |
| 5 | 0.377 | 0.998 |
| 6 | 0.401 | 1.249 |
| Average | 0.448 | 1.183 |
| Standard Deviation | 0.059 | 0.144 |

As clearly evident, lotion transfer from the treated tissue products of the present invention is substantially enhanced. Specifically, lotion transfer enhancement is at least about 2X, more than 2.5X on average and up to more than 3X. Where X is the lotion transfer from web of the prior art (i. e. one not provided with an antimigration material).

The disclosure of all patents, patent applications (and any patents which issue thereon, as well as any corresponding published foreign patent applications), and publications mentioned throughout this description are hereby incorporated by reference herein. It is expressly not admitted, however, that any of the documents incorporated by reference herein teach or disclose the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A strong, soft tissue paper web comprising:

(a) papermaking fibers formed into a tissue web having opposed surfaces;

(b) an effective amount of an antimigration material having a wettability tension; and (c) an emollient lotion disposed on at least one of said surfaces of said web, said emollient lotion having a surface tension, whereby said wettability tension of said antimigration material is less than or equal to said surface tension of said emollient lotion.

2. The paper web of claim 1 wherein said antimigration material comprises a quaternary ammonium compound.

3. The paper web of claim 2 wherein said quaternary ammonium compound has the formula:

$$(R^1)_{4-m}—N^+—[R^2]_mX^-$$

wherein m is 1 to 3;

each $R^1$ is a $C_1$–$C_6$ alkyl or alkenyl group, hydroxyalkyl group, hydrocarbyl or substituted hydrocarbyl group, alkoxylated group, benzyl group, or mixtures thereof;

each $R^2$ is a $C_{14}$–$C_{22}$ alkyl or alkenyl group, hydroxyalkyl group, hydrocarbyl or substituted hydrocarbyl group, alkoxylated group, benzyl group, or mixtures thereof; and $X^-$ is any softener-compatible anion.

4. The paper web of claim 3 wherein $X^-$ is a halogen or methylsulfate.

5. The paper web of claim 4 wherein each $R^2$ is selected from $C_{16}$–$C_{18}$ alkyl.

6. The paper web of claim 5 wherein $X^-$ is methyl sulfate.

7. The paper web of claim 6 wherein the cationic portion of said quaternary ammonium compound is di(hydrogenatedtallow)dimethylammonium.

8. The paper web of claim 3 wherein said web further comprises a water-soluble permanent wet strength resin and a polyhydroxy plasticizer.

9. The paper web of claim 8 wherein said paper web comprises from about 0.01% to about 4.0% by weight of said quaternary ammonium compound, from about 0.01% to about 4.0% by weight of said polyhydroxy plasticizer, and from about 0.3% to about 1.5% by weight of said water-soluble permanent wet strength resin.

10. The paper web of claim 9 wherein said water-soluble permanent wet strength resin is a polyamide-epichlorohydrin resin.

11. The paper web of claim 9 wherein the cationic portion of said quaternary ammonium compound is di(hydrogenatedtallow)dimethylammonium and wherein $X^-$ is methyl sulfate.

12. The paper web of claim 1 wherein said emollient lotion comprises a hydrocarbon emollient.

13. The paper web of claim 12 wherein said hydrocarbon emollient is selected from the group consisting of mineral oil, petrolatum, hydrocarbon waxes, and mixtures thereof.

14. The paper web of claim 13 wherein said hydrocarbon emollient comprises a mixture of mineral oil and a hydrocarbon wax.

15. The paper web of claim 13 wherein said lotion is disposed on said surface in a pattern of uniform discrete surface deposits.

16. The paper web of claim 13 wherein said lotion is disposed on said surface as a substantially continuous coating.

17. The paper web of claim 12 wherein said emollient lotion comprises at least about 50% hydrocarbon emollient.

18. An antimigration material for use with a tissue web wherein an emollient lotion has a contact angle of at least about 75° when said lotion is disposed on a surface comprising said antimigration material.

19. A strong, soft tissue paper web comprising:

(a) papermaking fibers formed into a tissue web having opposed surfaces;

(b) an effective amount of an antimigration material; and (c) an emollient lotion disposed on at least one of said surfaces of said web.

20. A process for making a strong, soft tissue paper web, said process comprising:

(a) providing papermaking fibers;

(b) adding an effective amount of an antimigration material to said papermaking fibers whereby said antimigration material has a wettability tension;

(c) forming a tissue web having opposed surfaces;

(d) applying an emollient lotion to at least one of said surfaces of said web, said emollient lotion having a surface tension wherein said wettability tension of said antimigration material is less than or equal to said surface tension of said emollient lotion.

21. A process for making a strong, soft tissue paper web, said process comprising:

(a) providing papermaking fibers;

(b) forming a tissue web having opposed surfaces;

(c) adding an effective amount of an antimigration material to said tissue web, whereby said antimigration material has a wettability tension;

(d) applying an emollient lotion to at least one of said surfaces of said web, said emollient lotion having a surface tension wherein said wettability tension of said antimigration material is less than or equal to said surface tension of said emollient lotion.

* * * * *